US006656104B1

(12) United States Patent
Forrester et al.

(10) Patent No.: US 6,656,104 B1
(45) Date of Patent: Dec. 2, 2003

(54) METHOD AND APPARATUS FOR WINDING SPOOLED MATERIALS

(76) Inventors: Mark Forrester, 1017 Lynwood Dr., Brea, CA (US) 92621; Kim J. Dato, 12204 Buckskin Trail, Poway, CA (US) 92064; Sherry L. Forrester, 1017 Lynwood Dr., Brea, CA (US) 92621; James E. Dato, 12204 Buckskin Trail, Poway, CA (US) 92064

( * ) Notice: Subject to any disclaimer, the term of this patent is extended or adjusted under 35 U.S.C. 154(b) by 144 days.

(21) Appl. No.: 09/721,491

(22) Filed: Nov. 22, 2000

Related U.S. Application Data

(60) Provisional application No. 60/167,258, filed on Nov. 22, 1999.

(51) Int. Cl.[7] ..... B31B 1/36; B65H 17/27; B65H 19/08

(52) U.S. Cl. ..... 493/459; 242/166; 242/471; 242/615.4

(58) Field of Search ..... 493/459, 463, 493/464; 242/471, 166, 909, 615.21, 615.4, 615

(56) References Cited

U.S. PATENT DOCUMENTS

| | | | | | |
|---|---|---|---|---|---|
| 872,908 | A | * | 12/1907 | Cutter | 132/323 |
| 2,393,058 | A | * | 1/1946 | Pierce et al. | 264/281 |
| 3,026,397 | A | * | 3/1962 | Wolze | 118/235 |
| 3,729,367 | A | * | 4/1973 | Shore et al. | 156/204 |
| 3,855,777 | A | * | 12/1974 | Durkee et al. | 242/166 |
| 3,954,212 | A | | 5/1976 | Bolis | |
| 3,962,957 | A | * | 6/1976 | Hinzmann | 162/271 |
| 3,997,122 | A | * | 12/1976 | Helfand et al. | 242/159 |
| 4,025,878 | A | * | 5/1977 | Predmore | 333/109 |
| 4,182,738 | A | * | 1/1980 | Casaert et al. | 264/210.2 |
| 4,413,792 | A | | 11/1983 | O'Connor | |
| 4,449,652 | A | * | 5/1984 | Coppins et al. | 223/46 |
| 4,477,035 | A | * | 10/1984 | O'Connor | 242/471 |
| 4,498,640 | A | * | 2/1985 | Nowak | 242/471 |
| 4,509,702 | A | * | 4/1985 | Reese | 242/157 R |
| 4,538,773 | A | * | 9/1985 | McEathron | 242/157 R |
| 4,693,429 | A | * | 9/1987 | Billard et al. | 242/157 R |
| 4,759,512 | A | * | 7/1988 | Gaiser | 242/471 |
| 4,802,636 | A | * | 2/1989 | Frick et al. | 242/471 |
| 5,036,590 | A | * | 8/1991 | Reinke et al. | 30/261 |
| 5,054,699 | A | | 10/1991 | DeJaynes | |
| 5,122,211 | A | * | 6/1992 | Roach | 156/173 |
| 5,169,083 | A | * | 12/1992 | Sannohe et al. | 242/178 |
| 5,205,007 | A | | 4/1993 | Goldstein | |
| D335,252 | S | | 5/1993 | DeJaynes | |
| 5,215,615 | A | * | 6/1993 | Forsythe | 156/169 |
| 5,232,132 | A | * | 8/1993 | Broussard et al. | 223/44 |
| 5,316,539 | A | * | 5/1994 | Leemhuis et al. | 162/197 |
| 5,395,469 | A | * | 3/1995 | Suggs et al. | 156/173 |
| 5,400,452 | A | | 3/1995 | Goldstein | |
| 5,407,417 | A | * | 4/1995 | Goldstein | 162/271 |
| 5,516,058 | A | | 5/1996 | Omokawa et al. | |
| 5,518,492 | A | | 5/1996 | Goldstein | |
| 5,547,413 | A | | 8/1996 | Murray | |
| 5,551,646 | A | | 9/1996 | Goldstein | |
| 5,564,145 | A | | 10/1996 | Goldstein | |
| 5,711,752 | A | | 1/1998 | Goldstein | |
| 5,722,613 | A | | 3/1998 | Michael | |

(List continued on next page.)

*Primary Examiner*—Stephen F. Gerrity
*Assistant Examiner*—Paul Durand
(74) *Attorney, Agent, or Firm*—Gazdzinski & Associates

(57) ABSTRACT

A method and apparatus for winding conditioned material onto a spool so as to maintain its desirable properties. In one embodiment, decorative ribbon is conditioned using a curling device and wound onto an elongated spool having a predetermined radius in an alternating, helical lay pattern so as to maintain the curl of the ribbon, and permit easy removal and storage thereof. In a second embodiment, two or more different types or colors of ribbon are wound either concentrically or in juxtaposed orientation onto the same spool. An apparatus for winding one or more of the aforementioned spools is also disclosed. A multi-spool dispenser for the curled ribbon is further described.

16 Claims, 14 Drawing Sheets

U.S. PATENT DOCUMENTS 5,791,590 A * 8/1998 Zuk et al. ..... 242/610.6
5,916,081 A 6/1999 Goldstein
6,064,853 A * 5/2000 Embry et al. ..... 162/271
6,074,592 A 6/2000 Shea
6,131,223 A 10/2000 Rehkemper et al.
6,260,342 B1 * 7/2001 Lehman ..... 428/10
6,261,216 B1 * 7/2001 Goldstein ..... 493/459
6,298,639 B1 * 10/2001 Shea ..... 223/46

* cited by examiner

METHOD AND APPARATUS FOR WINDING SPOOLED MATERIALS

This application claims priority to U.S. Provisional Patent Application Serial No. 60/167,258 filed Nov. 22, 1999, entitled "Method And Apparatus For Winding Spooled Materials."

BACKGROUND OF THE INVENTION

1. Field of the Invention

The present invention relates to wound or spooled materials, including decorative ribbon.

2. Description of the Related Art

Different types of wound or spooled materials are presently in use. For example, decorative ribbon, string, thread, tape, and the like are characteristically wound in a rotary fashion onto a spool to facilitate space-efficient storage and access to the material by a user. Winding these materials onto the spool is typically accomplished using a machine which rotates the receiving spool and the material delivery device (which feeds the material onto the spool) in relation to one another such that the material is deposited in generally concentric or helical layers. The resulting product is a spool of material which can be serially unwound by the user after purchase.

For some such spooled materials, however, conditioning or preparation of the material after being wound off of the spool by the user is desirable. One salient example of such conditioning is decorative ribbon. Such ribbon is commonly removed from the spool in the length required, and then "stripped" with a pair of scissors or other mechanical device (or even heat) to impart a curl to the ribbon for decorative purposes. Generally speaking, comparatively small radius curls (i.e., less than about 1 in radius) are most desirable, but this is dependent on a number of factors including user preference, size of the package or other application that the ribbon is being attached to, etc. The action of passing one side of the ribbon over the blade of the scissors alters the ribbon so that it curls preferentially and consistently in one direction relative to the longitudinal axis of the material. Speed is an important factor in this process, since the curl radius of the resulting ribbon varies in some proportion to the speed at which it passes over the blade. If a certain minimum speed is not achieved, the ribbon will not curl substantially. Humans being imperfect machines, the speed of the ribbon pull varies significantly from person to person, from pull to pull, and even within a given pull.

Furthermore, it is noted that the curl achieved using such prior art methods is difficult to maintain constant, and the radius of curl is difficult to control precisely. Also, kinks can occur in the ribbon while curling which make a given piece of curled ribbon non-uniform in appearance. This reduces the satisfaction provided to the user as well as any other individuals viewing the ribbon. There is also the labor involved with locating the scissors or other stripping device, and performing the stripping operation. Also, there is some potential for personal injury from the sharpened blade of the scissors or other stripping device, or heat from a curling device.

Additionally, the "twist" present in the ribbon is difficult to maintain uniform. Twist is imparted to the ribbon in order to form a helical shape such that when the ribbon is left free-standing, it generally defines the shape of a cylinder. If the curl/twist is non-uniform, then the helix formed by the ribbon when free-standing may be non-uniform as well, thereby resulting in an undesirable appearance.

Another desirable attribute of decorative ribbon in certain applications is the use of two or more distinct types or colors of ribbon in a single application. Traditionally, decorative ribbon of a single color or type is curled and applied in a single helix, the user potentially applying helices of different colors or types adjacent to but separate from one another. However, a different decorative effect may be achieved by intertwining the two or more distinct colors or types of ribbons in a generally concentric series of helices. Alternatively, the two or more types or colors of ribbon may be intertwined in two or more helices of common radius, one helix being juxtaposed or slightly translated along its longitudinal axis with respect to the other helix (or helices). To achieve such results using discretely wound helices would be prohibitively time consuming and tedious, since the user would be required to somehow concentrically or co-extensively wind the individual helices together after they were unwound from their respective spools.

Several different prior art approaches to curling and preparing ribbon are available. See, for example, U.S. Pat. No. 5,407,417 issued Apr. 18, 1995 entitled "Ribbon Curling Device", U.S. Pat. No. 5,551,646 issued Sep. 3, 1996 entitled "Ribbon Curling and Ribbon Splitting Device", and U.S. Pat. No. 6,074,592 issued Jun. 13, 2000 entitled "Method for Imparting Curl to Ribbon Material" and assigned Berwick Delaware, Inc. However, the foregoing inventions do not provide a mechanism by which the curled ribbon is ultimately stored in the desired helical geometry of substantially similar radius to that imparted to the ribbon during curling so as to maintain its shape to maximum degree practicable. Additionally, the application of heat to help impart and maintain curl such as that disclosed in the aforementioned '592 patent requires the ribbon to be wound around the heating surface. Hence, there is a finite duration the ribbon must be in contact with the heating surface in order to impart the curl, since there is a finite heat transfer coefficient between the materials (i.e., the ribbon will not heat to a sufficient curling temperature instantaneously, but rather over a finite interval).

Similarly, none of the foregoing prior art references disclose a method or apparatus for accomplishing concentric or co-extensive (juxtaposed) winding of different types or colors of decorative ribbon or other spooled materials.

Based on the foregoing, there is a need for an improved method and apparatus for winding conditioned materials onto a spool such that such materials retain desirable characteristics when removed from the spool at a later time. Such a method and apparatus would ideally (i) allow for the materials to retain their desirable characteristics while being stored on the spool for a significant period of time; (ii) eliminate the need for the end-user to condition the materials (including eliminating the time, labor, and cost potentially associated therewith); (iii) increase end-user satisfaction based on the ability to readily and easily obtain materials having highly uniform and precise conditioning; and (iv) make available concentrically or co-extensively wound materials of different types. Furthermore, such improved method and apparatus would allow the user to store, and dispense the conditioned material easily and conveniently, and in a space-efficient manner.

SUMMARY OF THE INVENTION

The invention disclosed herein addresses the foregoing needs by providing an improved method and apparatus for winding conditioned materials onto a spool.

In a first aspect of the invention, an improved method of winding conditioned material onto a spool is disclosed. In one specific embodiment, the material is decorative ribbon which is passed through a conditioning device to impart curl to the ribbon. Prior to or during curling, the desired physical properties of the material after conditioning are specified by the user. The curled ribbon is then wound in a generally helical fashion onto a spool having a diameter generally consistent with that of the radius of the curled ribbon. Accordingly, when the ribbon is subsequently removed from the spool by the user, the conditioned curl and other desirable properties are retained, thereby obviating further conditioning by the user.

In a second aspect of the invention, a method of winding two or more types or colors of material (e.g., decorative ribbon) in a concentric fashion is disclosed. The method generally comprises providing unconditioned ribbon of two or more distinct types or colors; simultaneously passing the different ribbons through parallel conditioning apparatus, each apparatus imparting a curl of slightly different radius to its respective ribbon; and winding the different ribbons concentrically onto a common spool in helical lay fashion such that the different ribbon types at least partially overlay each other.

In a third aspect of the invention, a method of winding two or more types or colors of material (e.g., decorative ribbon) in a translated, co-linear or co-extensive fashion is disclosed. The method generally comprises providing unconditioned ribbon of two or more distinct types or colors; simultaneously passing the different ribbons through parallel conditioning apparatus, each apparatus imparting a curl of common radius to its respective ribbon, yet offset laterally from the other ribbon type(s); and winding the different ribbons in translated co-linear fashion onto a common spool in helical lay fashion.

In a fourth aspect of the invention, an apparatus for winding the material onto one or more spools is disclosed. In one embodiment, the device comprises at least one feed or supply spool containing unconditioned ribbon, a conditioning device which is laterally positioned with respect to at least one selectable take-up spool, and a motive source for driving the take-up spool. The unconditioned ribbon is taken from the supply spool, passed through the conditioner for curling/twisting, and then wound onto the take-up spool in a generally helical pattern which crosses back and forth along the longitudinal axis of the take-up spool. The selected diameter of the spool, in conjunction with the helical lay pattern, aids in maintaining the curl and twist of the ribbon after conditioning. When fully loaded, the take-up spool is removed and an empty spool put in its place. In a second embodiment, the apparatus includes a plurality of supply spools, conditioning devices, and take-up spools such that more than one spool can be wound in parallel. In a third embodiment, the apparatus further includes a tensioning device for controlling the tension of the material as it passes through the conditioning device, and detecting breakage of the material during conditioning/winding.

In a fifth aspect of the invention, an improved spool of conditioned material is disclosed. In one embodiment, the spool comprises a spool of circular cross-section in which the diameter is chosen to approximate the curl radius produced by the conditioning device. The foregoing spool embodiment further has a longitudinal dimension which is substantially greater than that of its diameter, thereby allowing the spool to accommodate appreciable amounts of helically wound ribbon. In another embodiment, the improved spool of the invention includes a usage indicator for indicating to a user the amount of material used from (or alternatively, the amount remaining on) the spool. The indicator comprises two raised ring elements disposed at either end of the spool having periodic concentric markings or indications of radial elevation above the base level (i.e., outermost surface) of the spool winding area. Since the ribbon is wound in uniform helical lay pattern across the spool winding area, the elevation of ribbon at the ends of the spool is effectively identical to that at other locations along the longitudinal axis of the spool. Hence, the ends of the spool can be used by the user as ready visual indicators of the amount of ribbon remaining on the spool. This approach obviates the user having to count the number of linear feet of ribbon used and subtract this value from the total initially wound onto the spool, or visually approximating the amount used or remaining.

In a sixth aspect of the invention, an improved apparatus for conditioning ribbon is disclosed. In one embodiment, the apparatus comprises a mechanical curling element and a curling cylinder. The curling element and cylinder are adapted to fit in close tolerance, thereby providing for proper alignment and some frictional resistance to help control tension, yet permit ribbon to pass there between so as to curl the ribbon against the edge of the curling element upon egress. The tolerance between the curling element and cylinder are also optionally controllable by the operator (or alternatively the aforementioned tensioning unit) to maintain the desired tension on the ribbon as it passes through the conditioning device.

In another embodiment, the curling element further includes a resistive heating element disposed in close proximity to curling surface of the element, thereby elevating the temperature of the curling surface such that curl is more readily imparted to the ribbon as it traverses the curling surface.

In yet another embodiment, a pre-heating element is disposed within the curling cylinder. The preheating element comprises a resistive heating element which raises the temperature of the curling cylinder to a desired value sufficient to enhance curling of the ribbon by the curling element, whether or not the aforementioned curling element heater is employed.

In a seventh aspect of the invention, an improved dispenser for the aforementioned ribbon is disclosed. In one exemplary embodiment, the dispenser comprises a generally cylindrical tube having a central cavity and an opening on at least one end, the tube being adapted to accommodate a plurality of different ribbon spools of the type disclosed herein within its central cavity. A plurality of longitudinal slits are formed in the tube to permit the expedient removal of the conditioned ribbon from one or more of the spools.

DETAILED DESCRIPTION OF THE INVENTION

Reference is now made to the drawings wherein like numerals refer to like parts throughout.

It is noted that while the following description is cast primarily in terms of an apparatus and method for winding decorative ribbon(s) onto one or more spools, the concepts and methods of the present invention may be used with other types of materials and in other applications with equal success. The method and apparatus of the invention can conceivably be applied to other "coiled" materials such as, for example, telephone cord. Accordingly, the invention is in no way meant to be limited to decorative ribbon; rather, its scope is defined by the claims appended hereto.

Figure 1:
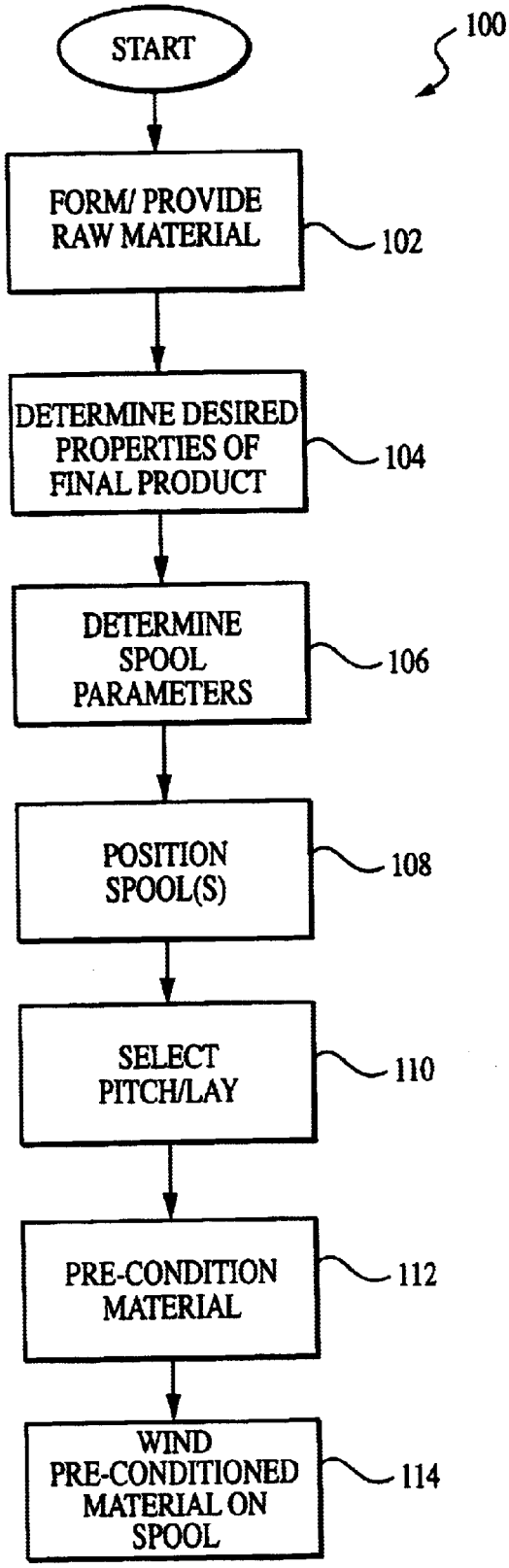
FIG. 1 is a logical block diagram of one exemplary embodiment of the material conditioning and fabrication methodology of the present invention.

Referring now to FIG. 1, one embodiment of the method 100 of conditioning and winding material onto a spool according to the invention is described. As shown in FIG. 1, the method 100 comprises first providing or forming the "raw" or unconditioned material in step 102. In the illustrated embodiment, such unconditioned material would be uncurled decorative ribbon of the type well known in the art. Next, in step 104, the desired properties of the ribbon are optionally determined by the operator. Such properties may include, for example, the approximate mean radius of curl. Based on the type and size of ribbon provided in step 102, and certain mechanical settings or parameters associated with the winding apparatus (as discussed further herein with respect to FIGS. 5*a*–5*c*), the physical properties of the ribbon, such as curl radius and resiliency, may vary.

Knowing the desired mean radius, the radius of the spool core 122 (FIG. 1*a*) to be wound is determined in step 106 such that the radius of the core 122 roughly approximates that of the desired mean radius selected in step 104. Note that the selection of spool core radius may simply be approximated by the user if desired based on empirical data (such as observing the radius of the conditioned ribbon after curling), or other data.

After the core size is selected in step 106, the core is positioned in step 108 on the winding apparatus (one embodiment shown in FIGS. 5*a*–5*c* herein) in step 108. Next, the pitch or lay of the material (i.e., how many turns of material are wound per unit distance of length along the longitudinal axis 123 of the core 122 of FIG. 1*a*) is optionally selected in step 110. Next, in step 112, the material to be wound is conditioned using the conditioning apparatus of the invention (FIGS. 5*a*–5*c*), and wound onto the core 122 in step 114 to produce the finished spool of material 120.

Figure 1A:
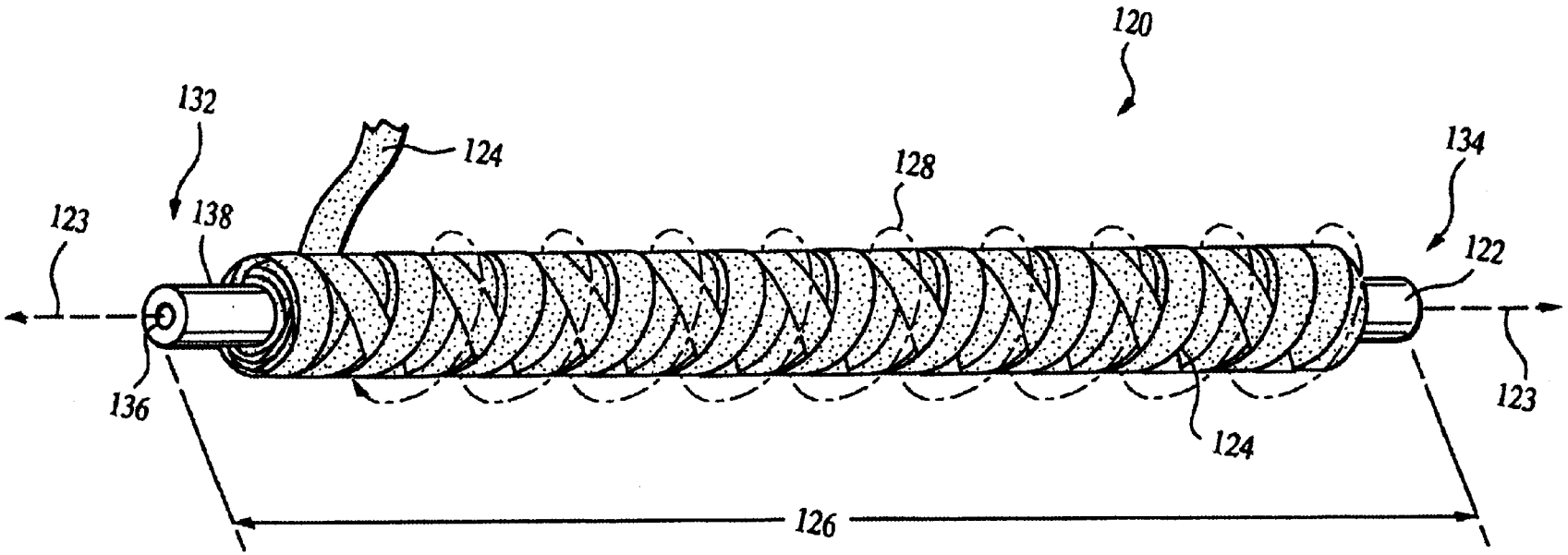
FIG. 1*a* is a partially exploded view of one embodiment of a finished material spool prepared according to the method of FIG. 1.

Referring now to FIG. 1*a*, one embodiment of the finished spool 120 produced using the method of FIG. 1 is illustrated. In the embodiment of FIG. 1*a*, the spool 120 comprises a generally cylindrical spool core 122 and a length of material 124 wound thereon. In the illustrated embodiment, the material 124 comprises decorative ribbon which is wound onto the core in a generally helical, overlapping fashion; i.e., the material traverses all or part of the length 126 of the core 122 in a helix 128 which propagates back and forth along the direction of the longitudinal axis 123 of the core. Specifically, in the illustrated embodiment, the material 124 is attached near one end 132 of the core 122, and then wound in a helical fashion along the core 122 at the desired pitch until the opposite longitudinal end 134 is reached, at which point the helix overlaps itself and the direction of traversal is reversed. It will be recognized by those of ordinary skill, however, that any number of different winding patterns or combinations of patterns may be used, including a "straight" wind wherein the curled ribbon is wound without traversing between the ends 132, 134 of the core more than once. The core 122 is comprised of a substantially rigid polymeric material such as nylon or polyethylene, although myriad other materials and physical characteristics may be substituted. The core further includes a cylindrical bore 136 formed longitudinally along the center of the core 122 to permit the spool 120 to be mounted on a corresponding mechanism for winding; see discussion of FIGS. 5*a*–5*c* below. The outer surface 138 of the spool 120 may have a flat surface, or be textured or otherwise coated to permit adhesion of the ribbon thereto or to prevent lateral movement after winding. The core 122 may be of any length, depending on the needs of the user or the particular characteristics desired. Generally, a shorter core 122 will be easier for a consumer to handle and store, while the longer core 122 is useful for, inter alia, manufacturing or mass production applications.

Figure 2:
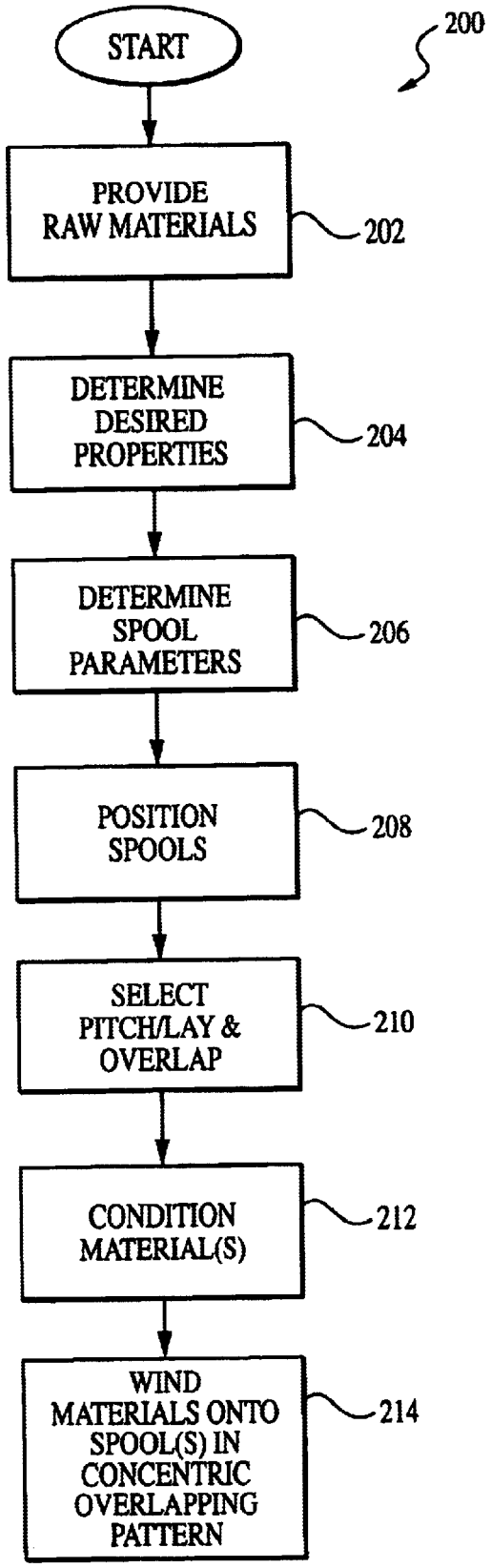
FIG. 2 is a logical block diagram of one exemplary embodiment of the method of concentrically winding material such as decorative ribbon onto a single spool according to the invention.

Referring now to FIG. 2, one embodiment of the method 200 of conditioning and winding different types and/or colors of material onto a spool in concentric fashion according to the invention is described. As shown in FIG. 2, the method 200 comprises first providing or forming the "raw" or unconditioned materials in step 202. In the illustrated embodiment, such unconditioned material would be uncurled decorative ribbon of two or more types (e.g., textures, patterns, or colors). Next, in step 204, the desired properties of the ribbon are optionally determined by the operator. Such properties may include, for example, the approximate mean radius of curl. Based on the types and sizes of ribbon provided in step 202, and certain mechanical settings or parameters associated with the winding apparatus (as discussed further herein with respect to FIGS. 5*a*–6*c*), the physical properties of the ribbon, such as curl radius and resiliency, may vary.

Knowing the desired mean radius, the radius of the spool core 222 (FIG. 2*a*) to be wound is determined in step 206 such that the radius of the core 222 roughly approximates that of the desired mean radius selected in step 204. Note that the selection of spool core radius may simply be approximated by the user if desired based on empirical data (such as observing the radius of the conditioned ribbon after curling), or other data.

In the case of concentrically would ribbons of various type, the intent is to wind the different ribbons substantially atop one another onto the spool 220. While the following discussion is cast in terms of two ribbons of the same type and texture, but having different color, it will be recognized that the method and apparatus of the present invention are easily extended to differing types of ribbon, as well as more than two discrete ribbons (e.g., three, or even four different types or colors). Such adaptations are well within the capabilities of one of ordinary skill in the mechanical arts when provided the present disclosure , and accordingly are not described further herein.

To concentrically lay the ribbon on the spool 220, an "over-under" arrangement comprising two discrete conditioning devices is utilized, as discussed in greater detail below. Specifically, when viewed along the longitudinal axis 223 of the spool 220, the individual conditioning devices are disposed at different radial angles from the direction of rotation of the spool such that the conditioned ribbon emerging from the first conditioning device is wound atop that from the second conditioning device.

After the core size is selected in step 206, the core is positioned in step 208 on the winding apparatus (one embodiment shown in FIGS. 5*a*–5*c* herein) in step 208. Next, the pitch or lay of the material (i.e., how many turns of material are wound per unit distance of length along the longitudinal axis 223 of the core 222 of FIG. 2*a*) is optionally selected in step 210. Next, in step 212, the material to be wound is conditioned using the conditioning apparatus of the invention (FIGS. 6*a*–6*c*), and wound onto the core 222 in step 214 to produce the finished spool of material 220.

Figure 2A:
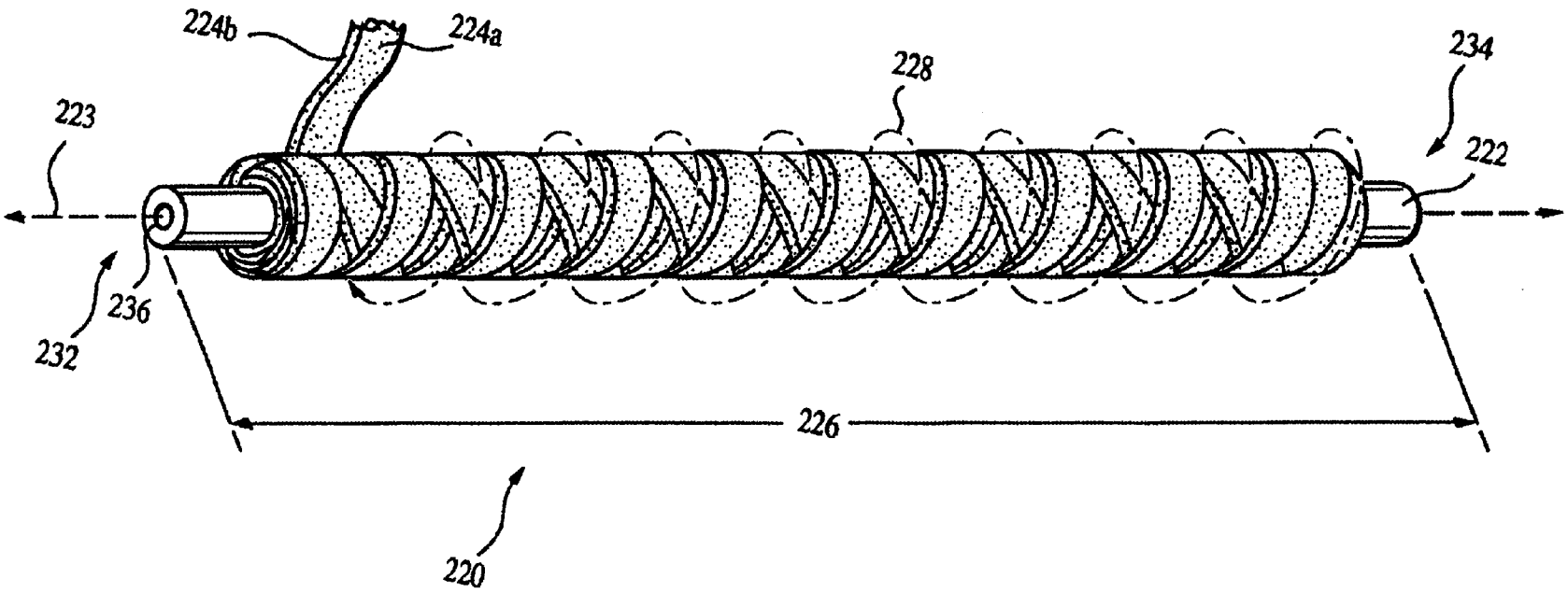
FIG. 2*a* is a partially exploded view of one embodiment of a finished material spool prepared according to the method of FIG. 2.

Referring now to FIG. 2*a*, one embodiment of the finished spool 220 produced using the method of FIG. 2 is illustrated. In the embodiment of FIG. 2*a*, the spool 220 comprises a generally cylindrical spool core 222 with bore 236 and a length of the two or more different materials 224*a*, 224*b* wound thereon. In the illustrated embodiment, the materials 224*a*, 224*b* comprise decorative ribbons of differing color which are wound onto the core in a generally helical, dual-overlapping fashion; i.e., the materials 224*a*, 224*b* are wound substantially one atop the other, and both materials traverse all or part of the length 226 of the core 222 in a helix 228 which propagates back and forth along the direction of the longitudinal axis 223 of the core. Specifically, in the illustrated embodiment, the materials 224 are attached near one end 232 of the core 222, and then wound in a helical fashion as previously described along the core 222 at the desired pitch until the opposite longitudinal end 234 is reached, at which point the helices overlap themselves and the direction of traversal is reversed. It will be recognized by those of ordinary skill, however, that any number of different winding patterns or combinations of patterns may be used, including a more "straight" wind wherein both strands 224*a*, 224*b* of the curled ribbon are wound concentrically but without traversing between the ends 232, 234 of the core more than once. The core 222 is comprised of a substantially rigid polymeric material such as nylon or polyethylene, although myriad other materials and physical characteristics may be substituted.

Figure 3:
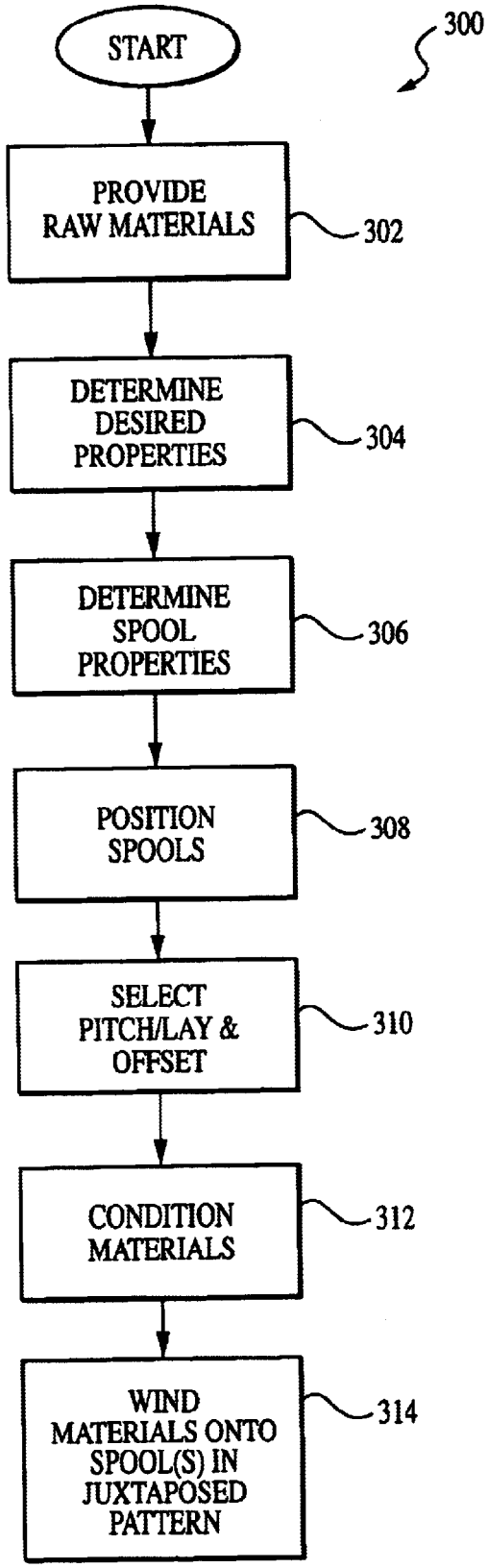
FIG. 3 is a logical block diagram of one exemplary embodiment of the method of co-linearly or co-extensively winding material such as decorative ribbon onto a single spool according to the invention.

Referring now to FIG. 3, one embodiment of the method 300 of conditioning and winding different types and/or colors of material onto a spool in co-extensive or juxtaposed fashion according to the invention is described. As shown in FIG. 3, the method 300 comprises first providing or forming the "raw" or unconditioned materials in step 302. In the illustrated embodiment, such unconditioned material would be uncurled decorative ribbon of two or more types (e.g., textures, patterns, or colors). Next, in step 304, the desired properties of the ribbon are optionally determined by the operator. Such properties may include, for example, the approximate mean radius of curl. Based on the types and sizes of ribbon provided in step 302, and certain mechanical settings or parameters associated with the winding, the physical properties of the ribbon, such as curl radius and resiliency, may vary.

Knowing the desired mean radius, the radius of the spool core 322 (FIG. 3*a*) to be wound is determined in step 306 such that the radius of the core 322 roughly approximates that of the desired mean radius selected in step 304. Note that the selection of spool core radius may simply be approximated by the user if desired based on empirical data (such as observing the radius of the conditioned ribbon after curling), or other data.

In the case of co-extensively wound or juxtaposed ribbons of various type, the intent is to wind the different ribbons in a substantially lateral or juxtaposed fashion onto the spool 220. While the following discussion is cast in terms of two ribbons of the same type and texture, but having different color, it will be recognized that the method and apparatus of the present invention are easily extended to differing types of ribbon, as well as more than two discrete ribbons (e.g., three, or even four different types or colors). Such adaptations are well within the capabilities of one of ordinary skill in the mechanical arts when provided the present disclosure , and accordingly are not described further herein.

To co-extensively lay the ribbon on the spool 220, a "side-by-side" arrangement comprising two discrete conditioning devices is utilized, as discussed in greater detail below. Specifically, when viewed from a direction normal to the longitudinal axis 323 of the spool 320, the individual conditioning devices are disposed at different positions along the longitudinal axis of the spool such that the conditioned ribbon emerging from the first conditioning device is wound in juxtaposed fashion with that emerging from the second conditioning device.

After the core size is selected in step 306, the core is positioned in step 308 on the winding apparatus in step 308. Next, the pitch or lay of the material (i.e., how many turns of material are wound per unit distance of length along the longitudinal axis 323 of the core 322 of FIG. 3*a*) is optionally selected in step 310. Next, in step 312, the material to be wound is conditioned using the conditioning apparatus of the invention, and wound onto the core 322 in step 314 to produce the finished spool of material 320.

Figure 3A:
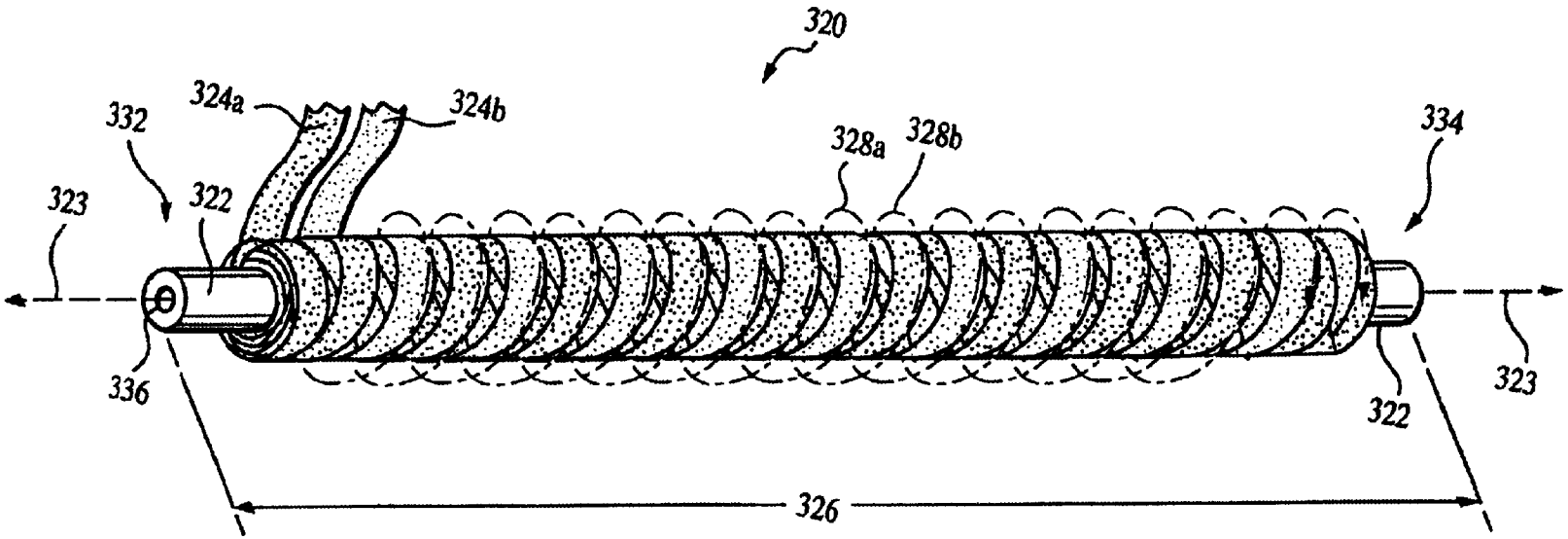
FIG. 3*a* is a partially exploded view of one embodiment of a finished material spool prepared according to the present invention.

Referring now to FIG. 3*a*, one embodiment of the finished spool 320 produced using the method of FIG. 3 is illustrated. In the embodiment of FIG. 3*a*, the spool 320 comprises a generally cylindrical spool core 322 with bore 336 and a length of the two or more different materials 324*a*, 324*b* wound thereon. In the illustrated embodiment, the materials 324*a*, 324*b* comprise decorative ribbons of differing color which are wound onto the core in a generally helical, juxtaposed and overlapping fashion; i.e., the materials 324*a*, 324*b* are wound substantially juxtaposed or next to one another, and both materials traverse all or part of the length 326 of the core 322 in juxtaposed helices 328*a*, 328*b* which propagate back and forth along the direction of the longitudinal axis 323 of the core. Specifically, in the illustrated embodiment, the materials 324 are attached near one end 332 of the core 322, and then wound in a helical fashion as previously described along the core 322 at the desired pitch until the opposite longitudinal end 334 is reached, at which point the helices overlap themselves and the direction of traversal is reversed. It will be recognized by those of ordinary skill, however, that any number of different winding patterns or combinations of patterns may be used, including a "straight" wind wherein both strands 334*a*, 334*b* of the curled ribbon are wound concentrically but without traversing between the ends 332, 334 of the core more than once.

Figure 4:
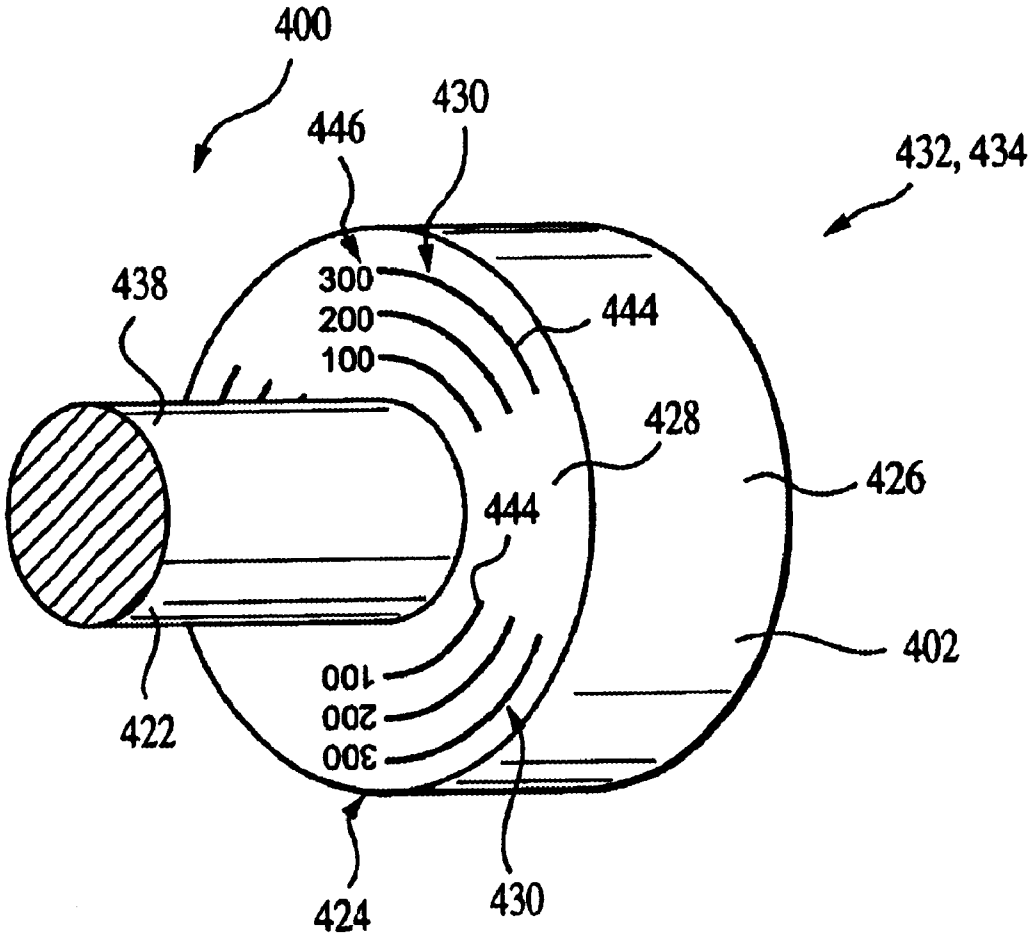
FIG. 4 is a partial perspective view of the winding spool of the invention, illustrating one exemplary embodiment of the material indicators thereof.

Referring now to FIG. 4, one embodiment of the wound material spool of the invention, such as that illustrated in FIGS. 1*a*, 2*a*, and 3*a*, yet further including visual indicator elements for determining the amount of remaining material, is described. As shown in FIG. 4, the spool 400 comprises at least one visual indicator element 402, disposed at either (or both) ends 432, 434 of the spool core 422 and concentric to the core. The indicator comprises a flat ring or toroid 424 which has a top surface 426 which is substantially parallel with the surface 438 of the core 422, yet elevated therefrom. The inboard side surface 428 of the indicator 402 includes a series of concentric indicators 430 which, in the illustrated embodiment, comprise a series of broken or hash-marked lines 444 of varying radius and having associated numerals 446, although it will be appreciated that any number of other types of indicators may be substituted. As the ribbon material(s) is/are wound onto the spool 400 in increasing amounts, the concentric indicators 430 are successively covered, thereby providing the user visual indication of the amount of material on the spool. That the numerals 446 are, in the present embodiment, keyed to the number of linear feet or centimeters wrapped onto the spool, based on a calculation using spool diameter and effective length, ribbon material thickness, lay offset and angle, etc. Such calculation is easily performed by those of ordinary skill in the mechanical arts, and accordingly is not described further herein. Note, however, that other types of numerals or representations may be substituted. For example, the absolute linear numerals previously described could be replaced with relative fractional representations of the amount of material remaining (e.g., "⅛", "¼", etc.).

As yet another alternative, the linear feet could be converted to an approximate value of effective linear feet; i.e., how many linear feet the curled ribbon occupies when taken off the spool. This latter value is easily calculated by taking the number of turns or curls per effective linear distance (based on the curl parameters chosen by the manufacturer as previously described) and multiplying this value by the value of linear distance per turn. For example if a lay of 20 turns per linear foot is specified, and each turn consumes 2 linear inches of ribbon, then 20×2 or 40 linear inches of ribbon is consumed to provide the one foot effective length. Hence, for a spool capable of handling 400 linear feet of ribbon, approximately 10 (400/40) one-foot long curls will be provided.

Many other such alternatives are possible, all clearly in possession of those of ordinary skill.

Figure 5A:
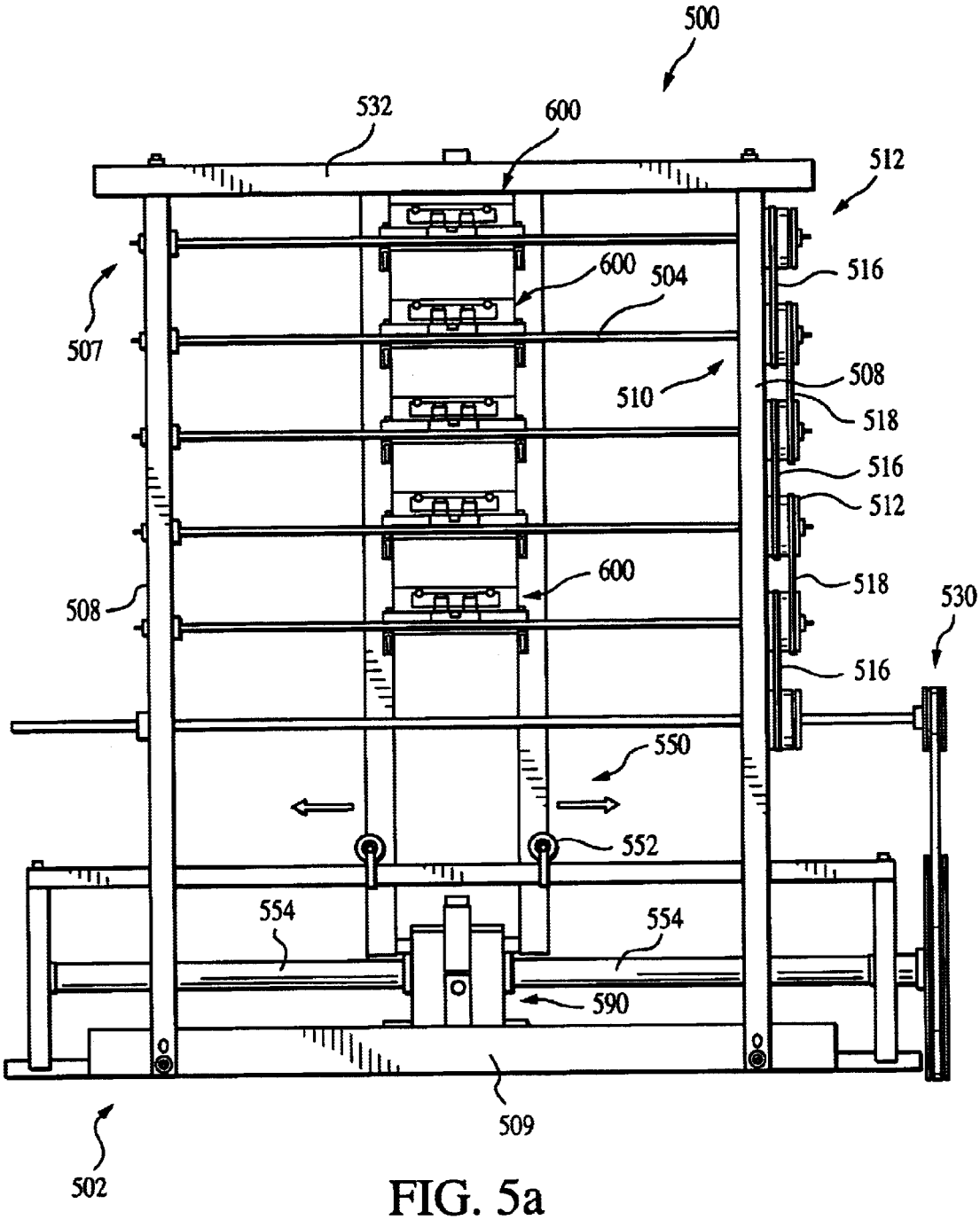
FIGS. 5*a*–5*c* are front, rear, and side views, respectively, of one embodiment of the material conditioning and winding apparatus of the present invention.
Figure 5B:
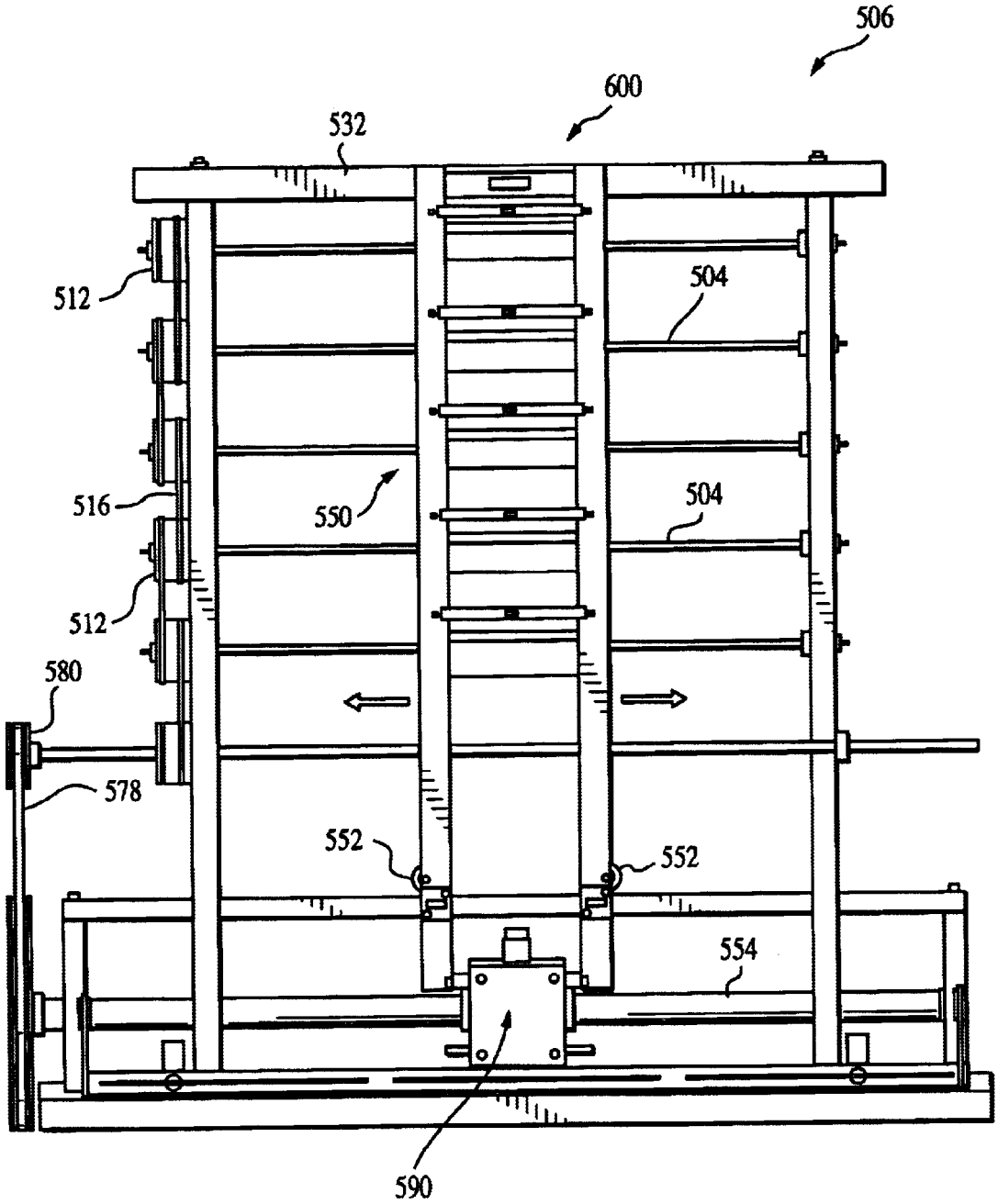
Figure 5C:
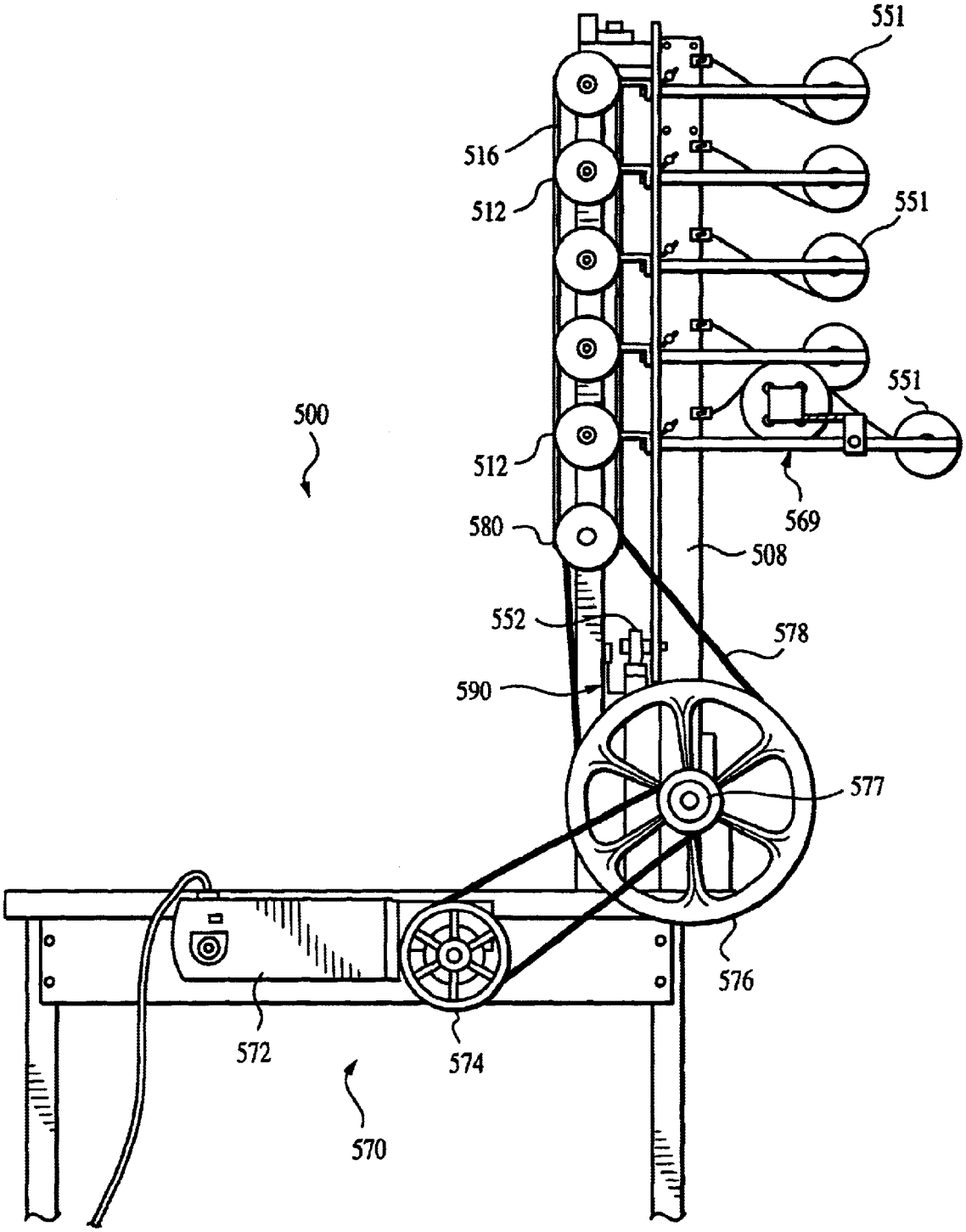

Referring now to FIGS. 5*a* through 5*c*, one exemplary embodiment of the material conditioning and winding apparatus of the present invention is described. As shown in 5*a*, the apparatus 500 comprises generally a support frame 502 which supports one or more transverse spool rods 504. The spool rods 504 are removable or otherwise accessible such that the aforementioned spools of material 120, 220, 320 may be readily inserted onto or removed from the rod. While the following discussion is cast in terms of the spools 120 of FIG. 1*a*, it will be recognized that the spools of FIGS. 2*a* and/or 3*a*, or even other types of spools, may be used consistent with the apparatus 500 of the invention. The bore 136 of the spool core 122 is sized so as to receive a spool rod 504 therein. The spool core 122 is then attached to the spool rod 504 using a collar or fastener element 507 having a set screw such that the two components will rotate in unison. This arrangement allows easy removal and insertion of the spool rods 504 from their respective spool core 122, yet slip-less winding of the ribbon on the core 122 when the set screw is tightened. Alternatively, the bore 136 of the spool core 126 may be sized so as to frictionally receive the spool rods therein. It will be recognized that myriad other arrangements for fastening the spool rods 504 to their respective spool cores 122 may be used, each of such arrangements being within those of ordinary skill in the mechanical arts.

Each of the spool rods 504 are supported within the vertical side posts 508 of the frame 502 such that the rods 504 freely rotate therein. In the present embodiment, a bushing (not shown) mounted in each vertical side post 508 is used, although other arrangements (such as roller bearings, or no bushing or bearing) may be used with equal success. One end 510 of each rod is also removably coupled to a pulley 512 of the type well known in the mechanical arts mounted outside of one of the vertical posts 508 such that when a given pulley 512 is rotated, its respective rod turns. The pulleys 512 each are adapted to receive two drive belts 516, 518; these drive belts couple multiple ones of the pulleys 512 together as shown in FIGS. 5*a*–5*c* such that when one pulley 512 is turned, each of the coupled pulleys turns as well. It will be recognized that the diameter of each pulley with respect to that of the other pulleys (and the drive pulley 530, described below) determines in part the relative rotational speed thereof. Hence, while the illustrated embodiment discloses the use of pulleys of the same diameter, pulleys of varying diameter (or even dynamically adjustable diameter) may be used, such as to wind differing types of ribbon on different spools 120, or wind spools of different radius such that the speed of material passing through the conditioning device 600 (FIGS. 6*a*–6*c*) is equilibrated.

A top support post 532 is joined to the vertical support posts 508 and adds lateral support thereto. The vertical posts 508 are mounted to a base 509 which may be either fixed or movable, such as being mounted on rollers for easy transport.

Figure 6A:
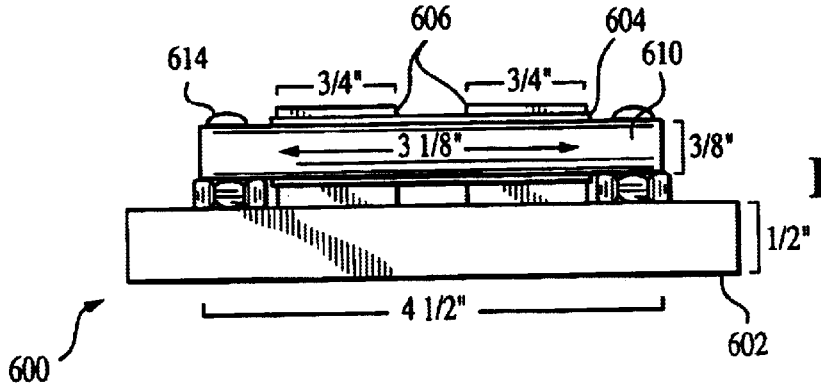
FIGS. 6*a*–6*c* are rear, perspective, and front views, respectively, of one embodiment of the material conditioning device of the present invention.
Figure 6B:
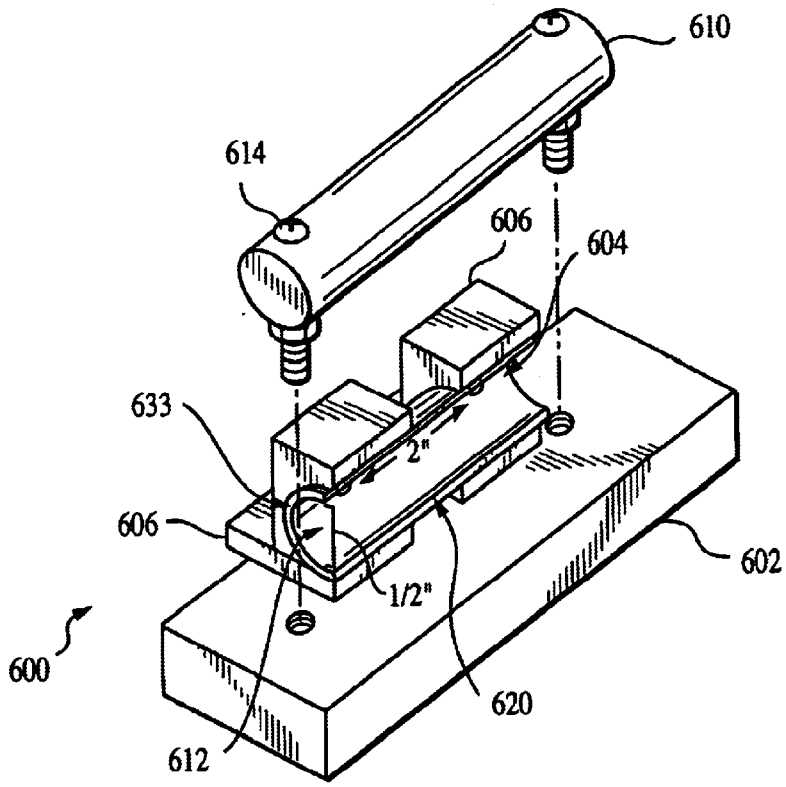
Figure 6C:
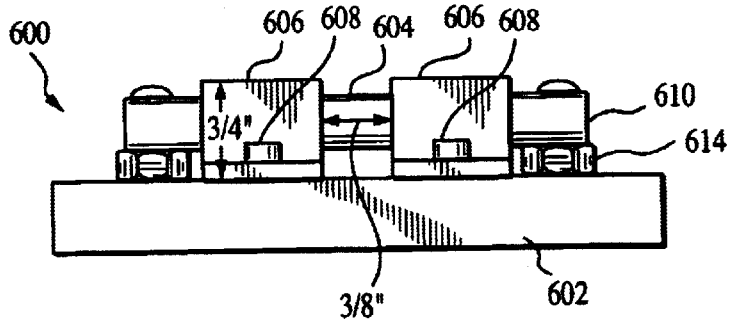

Referring to FIG. 5*b*, the apparatus 500 further includes a moving frame assembly 550 having one or more conditioning devices 600 as described with respect to FIGS. 6*a*–6*c* herein disposed thereon. The conditioning devices 600 are mounted generally one atop the other on the frame assembly 550 such that each device 600 is roughly level in height with the spool rods 504 previously described. In this fashion, ribbon (or other material) supplied by a supply spool 551 local to the inlet of each conditioning device 600 is conditioned and fed directly onto a respective spool 120 mounted on the rods 504, or alternatively fed onto a single spool in concentric fashion as previously described with respect to FIGS. 2 and 2*a* herein. The supply spools 551 are mounted on a series of transverse axes (not shown) such that they are generally free to rotate there about. The rotational friction or work required to rotate the spools 551 is variable by way of a frictional adjustment (such as a manually adjustable wing nut and bearing plate, not shown); this approach prevents the supply spools from "freewheeling" and over-rotating with respect to the conditioning device, thereby potentially causing ribbon to be improperly fed into the conditioning device 600.

In one embodiment, the frictional adjustments advantageously include a mechanism for varying the rotational friction as a function of material dispensed from the supply spools 551. As can be readily appreciated, the torque applied to each supply spool will vary as the effective diameter of the supply spool varies. The present embodiment includes a mechanism of the type well known in the mechanical arts for adjusting the friction applied to each supply spool 551 such that a substantially constant friction (and therefore tension on the material passing through the conditioning device 600) is maintained regardless of amount of material remaining on the supply spool(s).

The frame assembly 550 further includes a set of rollers 552 which are disposed on the assembly 550 so as to permit them to engage a crossbar 554 mounted transversely on the support frame 502 described above. In this fashion, the rollers 552 permit the frame assembly 550 to traverse the width (or some fraction thereof) of the support frame 502 laterally in a direction substantially parallel to the longitudinal axis of the spool rods 504, thereby depositing conditioned material (e.g., ribbon) from the conditioning devices 600 onto the spool(s) 120 simultaneously and in a predetermined pattern (e.g., helical lay pattern). A back-and-forth helical lay pattern is accomplished by varying the movement of the conditioning device(s) 600 in a substantially sinusoidal manner between the two opposing endpoints or stops of travel. Other patterns may also be substituted. The speed of lateral traversal in the illustrated embodiment may be coupled to the rotational speed of the spools 120 such that a constant ratio is maintained; this allows for uniform winding of the ribbon on the spools 120 regardless of winding speed. However, it will be appreciated that the speed of lateral traversal (and in fact the pattern in which the frame assembly 550 traverses the device 500, as previously described) may be de-coupled from the rotational speed of the spool rods 504 or otherwise independently controlled if desired.

A ribbon measuring device 569 of the type well known in the mechanical arts is also optionally mounted in cooperation with one or more of the supply spools so as to measure the quantity of ribbon (or other material) being wound onto the spools 120. Alternatively, a timing arrangement (i.e., by knowing the rate of deposition of ribbon, the amount disposed on the spool may be gauged by monitoring the winding time), or other similar arrangements may be used.

Referring to FIG. 5*c*, the drive mechanism 570 of the illustrated embodiment of the device 500 comprises a 115V single phase AC electric motor 572 having a pulley 574 on its output shaft which is connected via another rotating pulley 576 (with spindle 577), and belt 578 to the spool rod drive pulley 580, which is in turn is coaxial with a pulley attached via belts to the individual spool rod pulleys 512. Proper reduction for the selected motor is achieved by sizing the diameter of the pulleys as required, or using variable reduction gears, as is well known in the mechanical arts. The motor of the illustrated embodiment is also variably controllable for speed, although it will be recognized that other types of control schemes, motors, or rotational power sources may be substituted therefor. Lateral movement of the frame assembly 550 is accomplished using a drive unit 590 (FIG. 5*b*) which is coupled to the motor out-drive through a mechanical gearing or similar arrangement (not shown) such that as the pulley 576 and spindle 577 turn, the gearing of the drive unit 590 causes the drive unit (and connected frame assembly 550) to traverse laterally along the drive pulley spindle 577 and lateral crossbar 554 previously described. In the illustrated embodiment, a Travimatic™ level winder assembly manufactured by Geartronics Industries, Inc. of North Billerica, Mass. is used to provide the lateral motion of the frame assembly 550 and rotation of the spool rods 504 as described herein, although it will be appreciated that other arrangements may be used.

In addition to the foregoing, the winding apparatus 500 of the invention may be configured to include a tensioning unit (not shown) mounted on the apparatus 500 in relation to the material being wound such that a desired tension on the material is obtained. In certain circumstances, maintaining the tension on the ribbon being curled and spooled within a predetermined band may be important, since such tension may affect the ultimate curl imparted to the ribbon, as well as whether or not the ribbon deforms or even breaks. The tension applied generally will also vary between different types, thickness, and sizes of ribbon being wound. Such tensioning unit may also advantageously be used as a ribbon breakage detector; when the measured tension falls outside of the predetermined band, the apparatus 500 is braked or halted, or power secured, until the ribbon breakage can be repaired, or other faulty condition diagnosed and repaired.

The tensioning unit is generally disposed on the apparatus at the outlet of the conditioning device 600 (i.e., after the curling element) so as to most closely monitor the tension of the ribbon passing over the curling element. As will be described in later detail, the tension on the ribbon will vary as a function of its location within the apparatus 500, Since the aforementioned frictional adjustments on the supply spool, and the friction generated by the conditioning device 600 (described below) also contribute to the effective tension on the ribbon.

Referring now to FIGS. 6*a*–6*c*, one exemplary embodiment of the material conditioning device 600 of the invention is described. While the following description relates to the embodiment of FIGS. 6*a*–6*c* which is used to curl ribbon, it will be appreciated that other types of conditioning devices (whether mechanical or otherwise) may be used. For example, the conditioning device may comprise a thermal conditioner (not shown) which alters some physical parameter of the material passing there through using heat, infrared, or laser energy. Many other embodiments known to those of skill in the art may be substituted, depending on the particular application.

The conditioning device 600 generally comprises a base element 602 to which a curling element 604 is attached via one or more support elements 606 and associated fasteners 608. A curling cylinder 610 is adapted to fit within the curved radius 612 of the curling element 604, and is maintained in place by hardware 614 which attaches the cylinder 610 to the base element 604. The curling element 604 further includes a curling edge 620, which in the illustrated embodiment comprises one or more sharpened edges over which the material (ribbon) to be conditioned is passed, thereby imparting curl. The cylinder 610 and curling element 604 cooperate to maintain the ribbon in contact with the curling edge 620 as the ribbon passes between the cylinder 610 and curling element 604 in the gap 633 formed there between. It will be recognized by those of ordinary skill that the selection of the taper and sharpness of the edge 620, as well as the speed at which the ribbon is passed over the edge 620 and tension on the ribbon as it passes over the edge, dictate at least in part the radius of curl and mechanical properties of the ribbon after conditioning.

Ideally, the illustrated curling device components 604, 610, 620 are fabricated from metal for reasons of longevity; however, other materials such as for example polymers, composites, or ceramics may be substituted.

In another embodiment, the friction applied to the ribbon as it passes through the conditioning device(s) 600 is variable by way of a variable tolerance gap 633. Specifically, as the gap between the cylinder 610 and curling element 604 is reduced, the friction applied by the device 600 (and consequently the tension on the ribbon between the uptake spool (s) 120 and conditioning device(s) 600) is increased. Hence, the aforementioned optional tensioning device, in one embodiment, adjust the tension so as to maintain it in the desired band by selectively controlling the gap 633 of the conditioning device. Mechanisms adapted to provide such variable gap, as well as the control logic necessary to maintain the tension (as measured by the tensioning unit) in the desired band are well known in the mechanical and electrical control arts, and accordingly are not described further herein.

Figure 7:
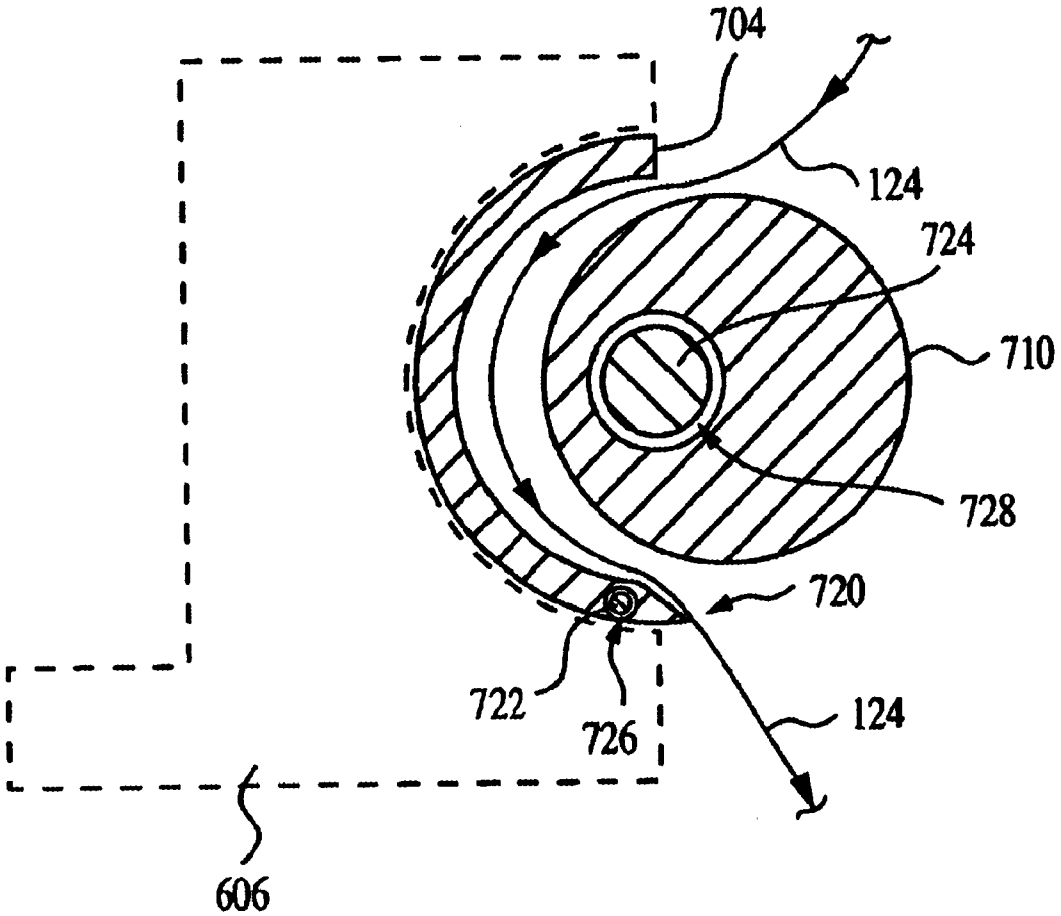
FIG. 7 is a cross-sectional view of a second embodiment of the material conditioning device of the invention, including curling blade and curling cylinder heating and preheating elements disposed therein, respectively.

FIG. 7 illustrates yet another embodiment of the conditioning device of the invention. In this embodiment, the curling element 704 and curling cylinder 710 include one or more resistive heating elements 722, 724 disposed within the curling element and cylinder, respectively. The heating element 724 disposed within the curling cylinder acts as a pre-heater, and heats the ribbon passing over it only part way to the temperature needed to impart and/or maintain curl in the ribbon. The heating element 722 disposed within the edge of the curling element 704 added the remaining heat necessary to achieve/maintain curling of the ribbon, and is heated to a substantially higher temperature at its edge 720 than the cylinder 710, especially since the effective contact area of the edge 720 is much smaller than that of the cylinder 710. The energization of the resistive heating elements may controlled by any number of different techniques, such as using thermocouples or resistance temperature detectors (RTDs) embedded within the cylinder 710 and/or curling element 704. The present invention further contemplates the use of different temperature values (and differentials between the cylinder and curling element) for various different types of materials, thickness, etc.

It will also be recognized that while the embodiment of FIG. 7 illustrates the heating elements 722, 724 disposed physically within the respective components of the conditioning device 700 in cavities 726, 728 formed therein, such heating elements 722, 724 may be disposed on the surface of the respective components 704, 710,. Alternatively, the heating elements may comprises other types of devices, such as infrared radiant heaters, heated liquids, or even lasers of the type well known in the art for rapidly heating materials.

It will further be recognized that heating may also or alternatively be applied to the ribbon after it is wound onto the spool 120, via any number of the aforementioned methods, in order to help set or maintain the curl of the ribbon. For example, resistive heating elements disposed within the spool rods 504 may be used to heat the spools 120 (and ribbon disposed thereon) to a satisfactory temperature which will not damage the ribbon or spool, yet assist in maintaining the curl. Similarly, metallic spool cores may be used if required to allow greater elevation of the surface temperature of the spool before, during, or after winding of the ribbon thereon.

Figure 8:
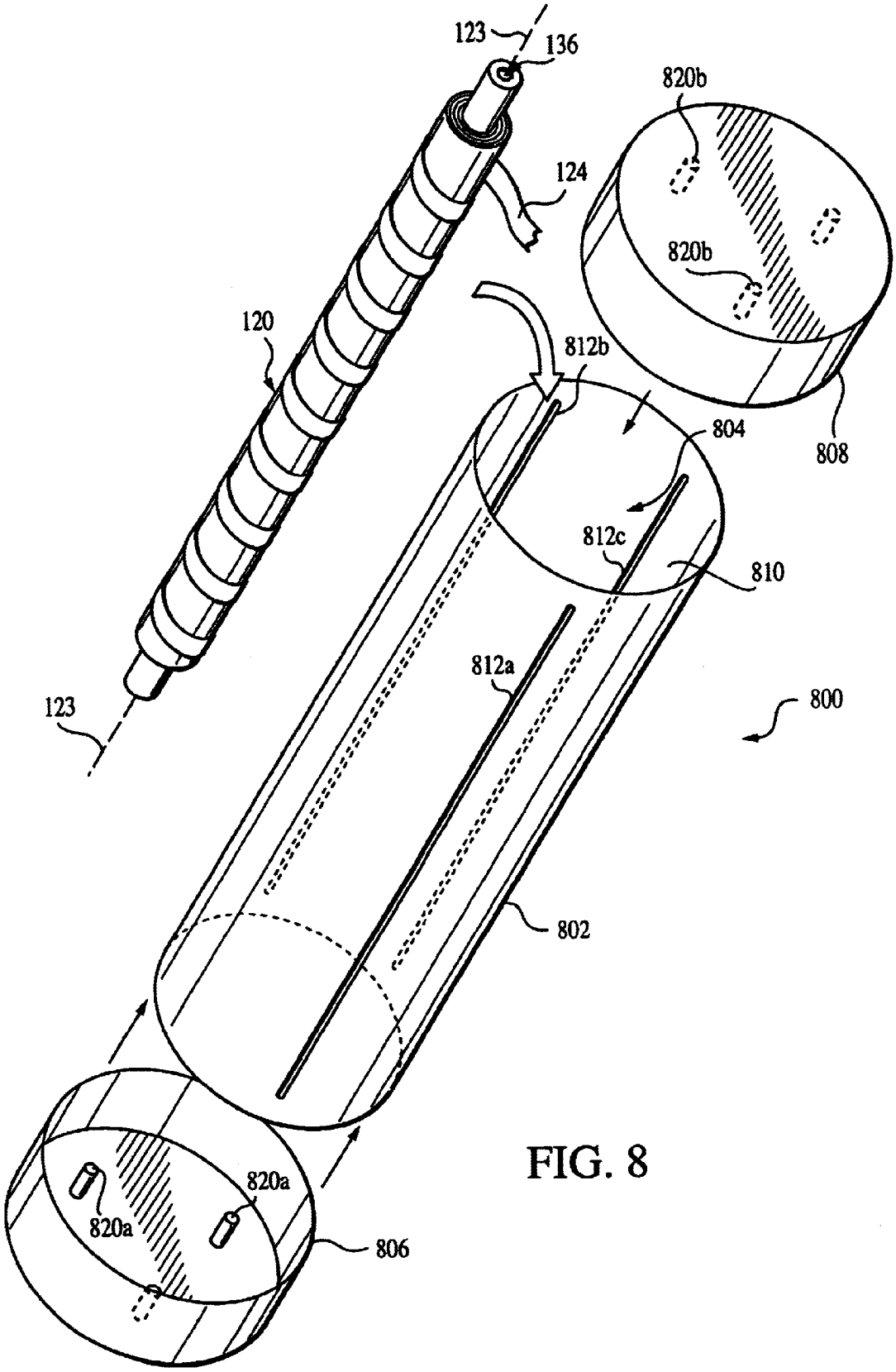
FIG. 8 is an exploded perspective view of one exemplary embodiment of the ribbon dispenser according to the present invention.

Referring now to FIG. 8, one exemplary embodiment of the ribbon dispenser of the invention is described. The dispenser 800 comprises generally a cylindrical tube 802 having an internal cavity 804, two end caps 806, 808, an aperture 810 through which spools of material 120 may be inserted, and at least one dispensing slit 812 formed longitudinally in the side of the tube 802. In the illustrated exemplary embodiment, three slits 812*a*, 812*b*, 812*c* are formed within the tube 802 at 120-degree angles from each other, although other configurations may be substituted. The tube is preferably constructed of a transparent or partially transparent materials such as clear polyethylene in order to permit viewing of the spools, although this feature is optional.

The end caps 806, 808 also optionally contain respective spindle elements 820*a*, 820*b* for one or more of the plurality of spools 120; the outside diameter of the spindle elements 802*a*, 802*b* is adapted to fit within the bore 136 of the spools 120 so that the spools rotate about their longitudinal axis 123 on the spindle elements when the dispenser 800 is assembled. It will be recognized that other configurations of spindle elements allowing for rotation of the spools may be substituted with equal success.

In the illustrated exemplary embodiment of FIG. 8, one of the end caps 806 is semi-permanently held in place when installed on one end of the tube 802, such as by a frictional interference fit, so that it may be removed if desired, but will require effort by the user to do so. The other end cap 808 is ideally made to be removed by the user more easily to facilitate changing out of the spools 800.

The dispenser 800 is hence loaded by removing the end cap 808, inserting the spools 120 such that the inserted end of each spool engages the respective spindle element 802*a* disposed on the attached end cap 806, threading the free end 824 of each spool 120 through its respective slit 812*a*, 812*b*, 812*c*, and then installing the free end cap 808 back onto the tube 802 such that the spindle elements 802*b* of the free end cap 808 engage respective ones of the spools 120, thereby allowing each spool to freely rotate about its longitudinal axis when the free end 824 of the ribbon on that spool is pulled. Optionally, a cutting device (not shown) may be attached to the dispenser 800 such that the desired length of ribbon may be cut by the user after it has been withdrawn from the dispenser.

Figure 9:
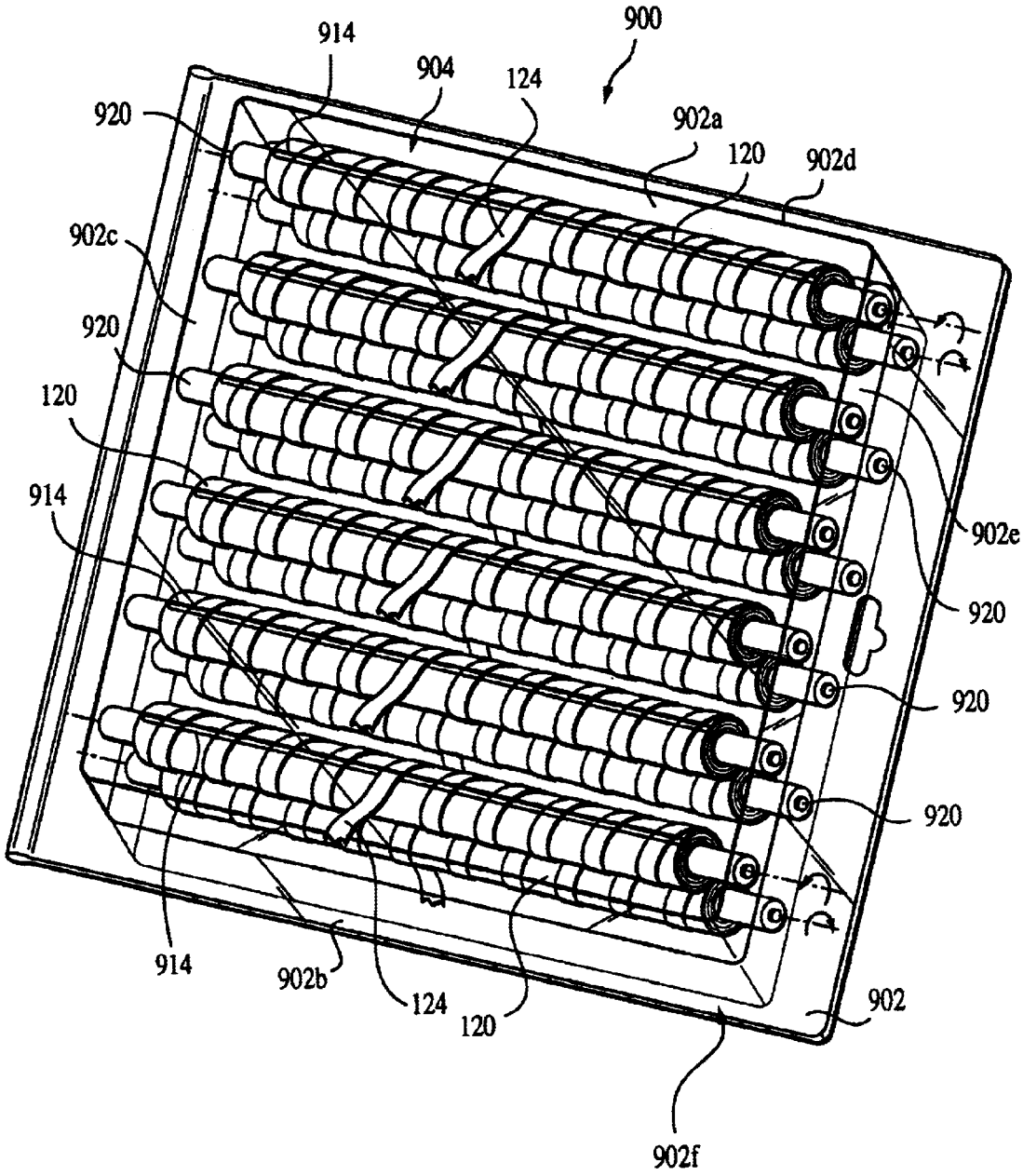
FIG. 9 is a perspective view of a second embodiment of the ribbon dispenser of the present invention.

FIG. 9 illustrates a second embodiment of the ribbon dispenser of the invention. As shown in FIG. 9, the dispenser 900 comprises a substantially rectangular container 902 formed of a clear or semi-transparent material such as polyethylene and having a recess 904 formed therein, the recess containing in the illustrated embodiment twelve (12) individual spools 120 of ribbon. The spools 120 are arranged in a side-by-side fashion, in two rows, such that each spool can rotate about its longitudinal axis 910 without interference from other spools or the side walls 902*a*–*f* of the container. A plurality (e.g., twelve) elongated slits 914 are disposed on the front wall(s) 902*a*, 902*f* of the container 902 and aligned with its respective spool 120 such that the ribbon 124 on each spool 120 may be dispensed to the outside of the container 902 through its respective slit 914. The slits are elongated and substantially co-extensive with the length of the ribbon spools to permit the entirety of the ribbon on each spool to be dispensed without opening the container 902.

In the illustrated embodiment, slits 914 are disposed on the two opposing faces 902*a*, 902*f* of the container such that, in practice, ribbon may be pulled from both sides of the dispenser 900 simultaneously, and in theory, from all twelve spools 120 simultaneously. Each spool 120 further includes spindle elements 920 either attached or formed in the recess 904 such that the relative positions of the individual spools are maintained within the container 902 during spool rotation, handling, transport, etc.

It is noted that the dispensers 800, 900 of FIGS. 8 and 9, respectively, are merely exemplary of the broader concepts, and myriad other configurations may be used. For example, the dispensers may be formed in a variety of different shapes, be constructed of any number of available materials having different properties (including transmission of visible light), have more or less ribbon spools, spindle mechanisms, and the like. Additionally, other apparatus such as ribbon cutters, or devices to maintain the free end of the ribbon(s) available for subsequent use may also be employed.

While the above detailed description has shown, described, and pointed out the fundamental novel features of the invention as applied to various embodiments, it will be understood that various omissions, substitutions, and changes in the form and details of the apparatus and methods illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

We claim:

1. An apparatus for winding spooled materials, comprising:

at least one supply spool adapted to supply a quantity of uncurled material;

at least one curling device having a curling blade with curling edge, said at least one device adapted to receive said uncurled material and produce curled material having a curl radius;

at least one receiving spool having a radius substantially similar to said curl radius and being adapted to store said curled material thereon; and a positioning device, adapted to position said at least one curling device with respect to respective ones of said at least one receiving spool, such that said curled material is disposed on said at least one receiving spool in a predetermined pattern;

wherein said predetermined pattern and said radius of said receiving spool cooperate to substantially maintain said curl radius.

2. The apparatus of claim 1, wherein said at least one receiving spool is heated to a temperature above ambient in order to assist in maintaining the curl of said curled material.

3. The apparatus of claim 1, wherein said at least one receiving spool further comprises an indicator for visually indicating the amount of curled material remaining on said at least one spool.

4. The apparatus of claim 1, wherein said positioning device is adapted to substantially traverse the width of said at least one spool so as to dispose said conditioned material thereon in a substantially helical lay pattern.

5. The apparatus of claim 4, wherein said positioning device is further adapted to alternate in substantially sinusoidal fashion between the two ends of said at least one receiving spool so as to form a back-and-forth helical lay pattern with said material.

6. The apparatus of claim 1, further comprising a tensioning apparatus adapted to maintain said material within a range of tension during curling.

7. An apparatus for winding spooled materials, comprising:

at least one supply spool adapted to supply a quantity of unconditioned material;

at least one conditioning device, said at least one device adapted to receive said unconditioned material and alter at least one physical property of said material in order to produce conditioned material;

at least one receiving spool being adapted to store said conditioned material thereon and having a radius substantially similar to an average radius of curl of said conditioned material; and a positioning device, adapted to position said at least one conditioning device with respect to respective ones of said at least one receiving spool, such that said conditioned material is disposed on said at least one receiving spool in a predetermined pattern;

wherein said at least one receiving spool is heated to a temperature above ambient in order to assist in maintaining the curl of said conditioned material.

8. The apparatus of claim 7, wherein said positioning device is adapted to substantially traverse the width of said at least one spool so as to dispose said conditioned material thereon in a substantially helical lay pattern.

9. The apparatus of claim 8, wherein said positioning device is further adapted to alternate in substantially sinusoidal fashion between the two ends of said at least one receiving spool so as to form a back-and-forth helical lay pattern with said material.

10. The apparatus of claim 7, further comprising a tensioning apparatus adapted to maintain said unconditioned material within a range of tension during curling.

11. The apparatus of claim 7, wherein said heating is accomplished using a resistive heating element disposed at least partly within said at least one receiving spool.

12. An apparatus for winding spooled materials, comprising:

a plurality of supply spools each adapted to supply a quantity of unconditioned material;

a plurality of curling devices, said devices each being adapted to receive said unconditioned material from respective ones of said supply spools and alter at least one physical property of said material in order to produce curled material;

a plurality of receiving spools, said receiving spools each being adapted to store said conditioned material received from its respective curled device thereon; and at least one positioning device adapted to simultaneously position each of said plurality of curling devices with respect to respective ones of said receiving spools, such that said curling material is disposed on said receiving spools in a predetermined pattern.

13. The apparatus of claim 12, wherein said plurality of conditioning devices are disposed within said positioning device in substantially vertical disposition.

14. An apparatus for winding spooled materials, comprising:

at least one supply means for supplying a quantity of uncurled material;

at least one curling means having a curling blade with curling edge, said at least one curling means adapted to receive said uncurled material and produce curled material having a curl radius;

at least one receiving means having a radius substantially similar to said curl radius and being adapted to store said curled material thereon; and a positioning means, adapted to position said at least one curling means with respect to respective ones of said at least one receiving means, such that said curled material is disposed on said at least one receiving means in a predetermined pattern;

wherein said predetermined pattern and said radius of said receiving means cooperate to substantially maintain said curl radius.

15. An apparatus for winding spooled materials, comprising:

at least one supply means for supplying a quantity of unconditioned material;

at least one curling means adapted to receive said unconditioned material and alter at least one physical property of said material in order to produce curled material;

at least one receiving means for storing said curled material thereon, said at least one receiving means having a radius substantially similar to an average radius of curl of said curled material; and a positioning means, adapted to position said at least one curling means with respect to respective ones of said at least one receiving means, such that said curled material is disposed on said at least one receiving means in a predetermined pattern;

wherein said at least one receiving means is heated to a temperature above ambient in order to assist in maintaining the curl of said curling material.

16. An apparatus for winding spooled materials, comprising:

a plurality of supply means each for supplying a quantity of unconditioned material;

a plurality of conditioning means, said curling means each being adapted to receive said unconditioned material from respective ones of said supply, means and alter at least one physical property of said material in order to produce curled material;

a plurality of receiving means, said receiving means each being adapted to store said curled material received from its respective conditioning means thereon; and at least one positioning means for simultaneously positioning each of said plurality of curling means with respect to respective ones of said receiving means, such that said curled material is disposed on said receiving means in a predetermined pattern.

* * * * *

UNITED STATES PATENT AND TRADEMARK OFFICE

CERTIFICATE OF CORRECTION

PATENT NO. : 6,656,104 B1
DATED : December 2, 2003
INVENTOR(S) : Forrester et al.

It is certified that error appears in the above-identified patent and that said Letters Patent is hereby corrected as shown below:

Column 16,
Lines 37-38, "being adapted to store said conditioned material received from its respective curled device thereon; and" should read -- being adapted to store said curled material received from its respective curling device thereon; and --
Line 42, "that said curling material is disposed on said receiving" should read -- that said curled material is disposed on said receiving --

Column 18,
Line 5, "a plurality of conditioning means, said curling means each" should read -- a plurality of curling means, said curling means each --

Signed and Sealed this

Ninth Day of March, 2004

JON W. DUDAS
*Acting Director of the United States Patent and Trademark Office*